US007841117B2

(12) United States Patent
Smith

(10) Patent No.: US 7,841,117 B2
(45) Date of Patent: Nov. 30, 2010

(54) KIT FOR SIGNAGE SUSPENSION

(76) Inventor: Kevin Smith, 12206 Chase St., Crown Point, IN (US) 46307

( * ) Notice: Subject to any disclaimer, the term of this patent is extended or adjusted under 35 U.S.C. 154(b) by 0 days.

(21) Appl. No.: 12/331,507

(22) Filed: Dec. 10, 2008

(65) Prior Publication Data

US 2009/0255159 A1 Oct. 15, 2009

Related U.S. Application Data

(63) Continuation-in-part of application No. 12/101,535, filed on Apr. 11, 2008, now Pat. No. 7,513,073.

(51) Int. Cl.
*G09F 11/04* (2006.01)

(52) U.S. Cl. ..... 40/607.05; 40/607.08; 40/610; 40/604; 248/156; 248/530

(58) Field of Classification Search ..... 40/607.06, 40/607.08, 604; 248/156, 545, 507, 508, 248/530

See application file for complete search history.

(56) References Cited

U.S. PATENT DOCUMENTS 1,153,450 A * 9/1915 Schaff ..... 52/155
4,249,715 A * 2/1981 Repp ..... 248/545
4,378,650 A * 4/1983 Ottoson ..... 40/607.08
4,524,533 A * 6/1985 Still, Jr. ..... 40/607.06
4,649,678 A * 3/1987 Lamson ..... 52/103
5,058,337 A * 10/1991 O'Connor ..... 52/162
5,502,910 A * 4/1996 Lucchesi ..... 40/607.06
5,568,785 A * 10/1996 Hazen ..... 116/209
6,334,596 B1 * 1/2002 Temple ..... 248/156
7,089,694 B2 * 8/2006 Allen ..... 40/607.04
7,117,619 B1 * 10/2006 Huber ..... 40/495

* cited by examiner

*Primary Examiner*—Cassandra Davis
(74) *Attorney, Agent, or Firm*—Ray Meiers; Meiers Law Office LLC

(57) ABSTRACT

A kit for suspending a sign is disclosed herein. The kit includes first and second column anchors operable to be mounted in the ground. Each column anchor has a plurality of fins facing in different directions from one another and a conical tip. The kit also includes first and second columns individually receivable in one of the first and second column anchors and selectively removable. Each of the columns has a plurality of through-apertures. The kit also includes a plurality of sets of eye-bolts and nuts, each individually receivable in one of the plurality of through-apertures. The kit also includes a plurality of cable members having latches or S-hooks at both ends and a stretchable member extending between the latches or S-hooks.

11 Claims, 3 Drawing Sheets

KIT FOR SIGNAGE SUSPENSION

CROSS-REFERENCE TO RELATED APPLICATIONS

This application is a continuation-in-part of U.S. patent application Ser. No. 12/101,535 for a KIT FOR SIGNAGE SUSPENSION filed on Apr. 11, 2008, now U.S. Pat. No. 7,513,073,which is hereby incorporated by reference in its entirety.

BACKGROUND OF THE INVENTION

1. Field of the Invention

The invention relates to a kit for suspending a sign or banner.

2. Description of Related Prior Art

Signs and banners can be used by businesses, schools, individuals, and groups of all kinds to convey information. Signs are often positioned in elevated relation relative to the intended observers of the sign. Signs can also be suspended outside and vulnerable to wind. In order to best convey information, a sign should be taut when suspended.

SUMMARY OF THE INVENTION

The invention is a kit for suspending a sign. The kit includes first and second column anchors operable to be mounted in the ground. Each column anchor has a plurality of fins facing in different directions from one another and a conical tip. The kit also includes first and second columns individually receivable in one of the first and second column anchors and selectively removable. Each of the columns has a plurality of through-apertures. The kit also includes a plurality of sets of eye-bolts and nuts, each individually receivable in one of the plurality of through-apertures. The kit also includes a plurality of cable members having latches or S-hooks at both ends and a stretchable member extending between the latches or S-hooks.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EXEMPLARY EMBODIMENT

Figure 1:
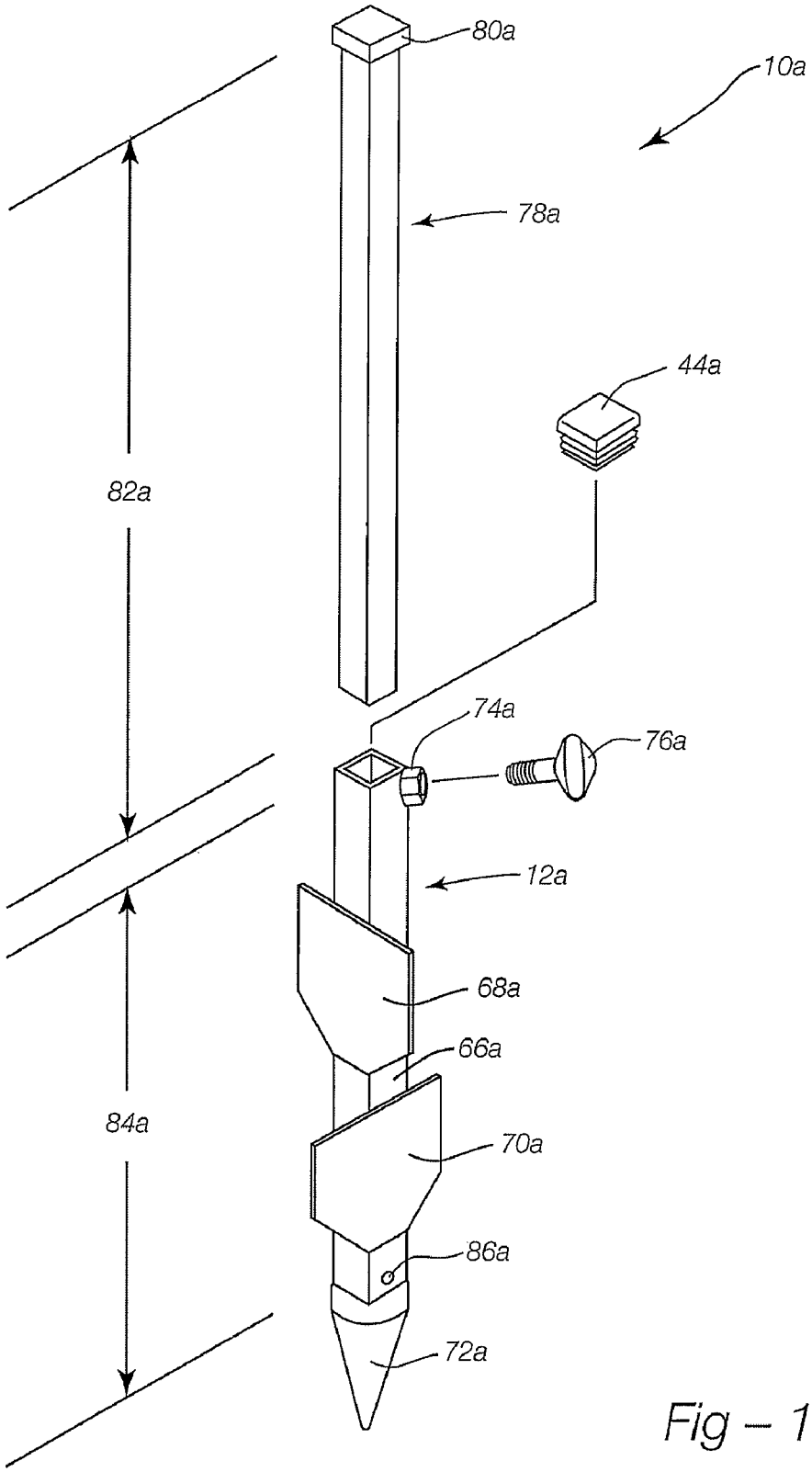
FIG. 1 is an exploded view of a first portion of a kit according to the exemplary embodiment of the invention.

The present application sets forth improvements made to the invention disclosed in U.S. patent application Ser. No. 12/101,535 for a KIT FOR SIGNAGE SUSPENSION filed on Apr. 11, 2008. The '535 application is hereby incorporated by reference in its entirety. Similar features are shown in the '535 application and the present application. Similar features have been numbered with a common reference numeral and have been differentiated by an alphabetic suffix. Also, to enhance consistency, the structures in any particular drawing share the same alphabetic suffix even if a particular feature is not shown in both applications. Similar features are structured similarly, operate similarly, and/or have the same function unless otherwise indicated by the drawings or this specification. Furthermore, particular features shown in the present application or the '535 application can replace corresponding features in the other application or can supplement arrangements in the other application unless otherwise indicated by the drawings or this specification in order to define alternative embodiments for practicing the present invention.

While those in the field of signage suspension have been satisfied by existing suspension systems, I have perceived the state of the art lacking. In an exemplary embodiment of my invention, a kit 10*a* can suspend a sign tautly and can do so repeatedly. My kit 10*a* is easy to use and yet provides consistently good results. The description below is directed to one side of a signage suspension kit; it is noted that the other side of the signage suspension kit can be structured similarly and operate similarly.

FIG. 1 shows a portion of a kit 10*a* according to the exemplary embodiment of my invention. The kit 10*a* can include first and second column anchors, such as column anchor 12*a*, operable to be permanently mounted in the ground or concrete. The column anchor 12*a* can include a hollow column sleeve portion 66*a* as well as first and second fins 68*a*, 70*a* fixed to the column sleeve portion 66*a*. The fins 68*a*, 70*a* can be facing different directions, such as perpendicular directions. In operation, the fins 68*a*, 70*a* can stabilize the column sleeve portion 66*a*. As shown in FIG. 1, the fins 68*a* and 70*a* are substantially flat and spaced from one another along the sleeve portion 66*a*. FIG. 1 also shows the fins 68*a* and 70*a* each extending along height (the height being defined along the sleeve portion 66*a*). The fins 68*a* and 70*a* are mounted flush to the sleeve portion 66*a* along the entire height. This prevents gaps without ground material forming between the fins 68*a* and 70*a* and the sleeve portion 66*a*. The fins 68*a*, 70*a* extend laterally past opposite sides of the sleeve portion 66*a* to define first and second surfaces wider than the sleeve portion 66*a* at different depths in the ground and facing in different, transverse directions from one another. The fins 68*a*, 70*a* are substantially rectangular to maximize the surface area confronting the ground. The fins 68*a*, 70*a* each include two chamfers at the bottom of the height to ease insertion into the ground. A conical tip 72*a* can be fixed to an end of the column sleeve portion 66*a* to ease insertion of the column sleeve portion 66*a* into the ground if the column sleeve portion 66*a* is not mounted in concrete.

The fins 68*a*, 70*a* define part of a post stabilizer system operable to be positioned underground. The sleeve portion 66*a* can be a shaft portion of the post stabilizer system. The exemplary sleeve portion 66*a* is hollow for receiving a post that extends above the ground. In other embodiments of the post stabilizer system, such as system without an anchor, a post for suspending signage can have the fins directly attached. The fin 68*a* is a first plate being substantially flat and fixed to the sleeve portion 66*a*. The fin 70*a* is a second plate being substantially flat and fixed to the sleeve portion 66*a*. The first and second fins 66*a* and 68*a* are spaced from one another along the sleeve portion 66*a* and are transverse one another. The flatness of the fins 66*a* and 68*a* enhances stability because the bends in non-flat fins are essentially predefined bending axes. It is more likely a signage suspension column or post will move when a fin can more easily deform about a bend. Spacing of the fins enhances stability because the signage suspension column or post is held at two or more locations along its length instead of one.

The column anchor 12*a* can also include a boss 74*a* defining a threaded aperture. The threaded aperture can extend fully through to an interior of the column sleeve portion 66*a*.

The threaded aperture can receive a thumb screw 76*a*, to be discussed in greater detail below.

The kit 10*a* can also include a driving member 78*a*. The driving member 78*a* can be received in the column anchor 12*a* and define a cap 80*a*. During installation into the ground, a hammer can be used against the cap 80*a* to drive the column anchor 12*a* downward, rather than being applied directly to the column anchor 12*a*. This exemplary process thereby reduces the likelihood mushrooming of the column anchor 12*a*. A length 82*a* of the driving member 78*a* can be greater than a length 84*a* of the column anchor 12*a* to further reduce the likelihood of mushrooming of the column anchor 12*a*. When the kit 10*a* is not in use, a cap 44*a* can be inserted in the column sleeve portion 66*a* to keep debris from the interior of the column sleeve portion 66*a*. Also, a drain aperture 86*a* can be defined in the column sleeve portion 66*a* to permit water to escape the interior of the column sleeve portion 66*a*.

Figure 2:
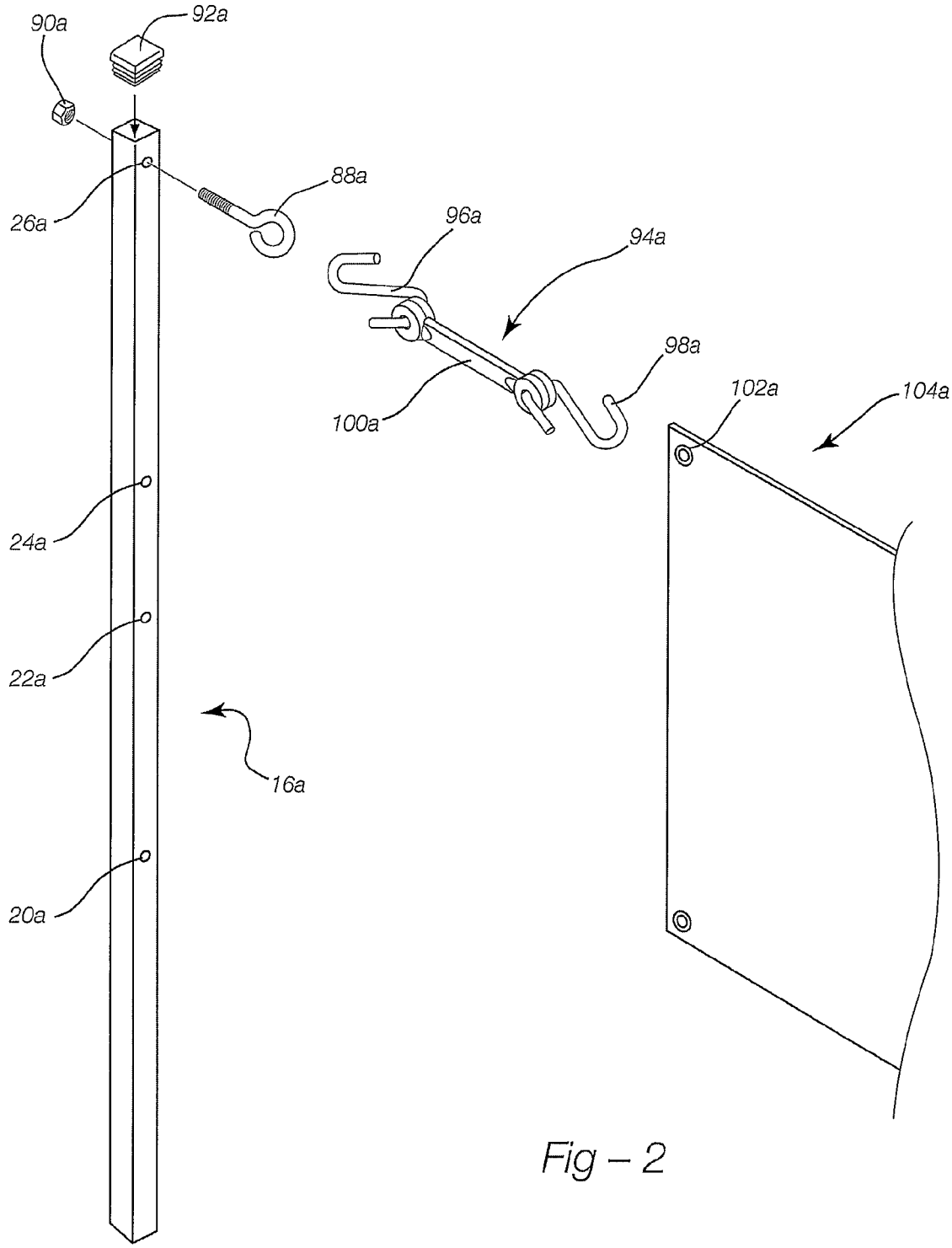
FIG. 2 is an exploded view of a second portion of a kit according to the exemplary embodiment of the invention.

Referring now to FIG. 2, the kit 10*a* can also include first and second columns, such as column 16*a*, receivable in the column anchors 12*a*. The column 16*a* can be made from steel, aluminum or any other materials. Generally, all the components of the kit 10*a* can be made from weather-resistant materials if desired. The column 16*a* is selectively removable from the column anchor 12*a* when the kit 10*a* is not in use. The column 16*a* can have a plurality of through-apertures such as through-apertures 20*a*, 22*a*, 24*a*, 26*a*. The through-apertures 20*a*, 22*a*, 24*a*, 26*a* can be spaced from one another the same distance or different distances. Spacing the through-apertures 20*a*, 22*a*, 24*a*, 26*a* different distances from one another could make the kit 10*a* operable to suspend signs of different heights.

Figure 3:
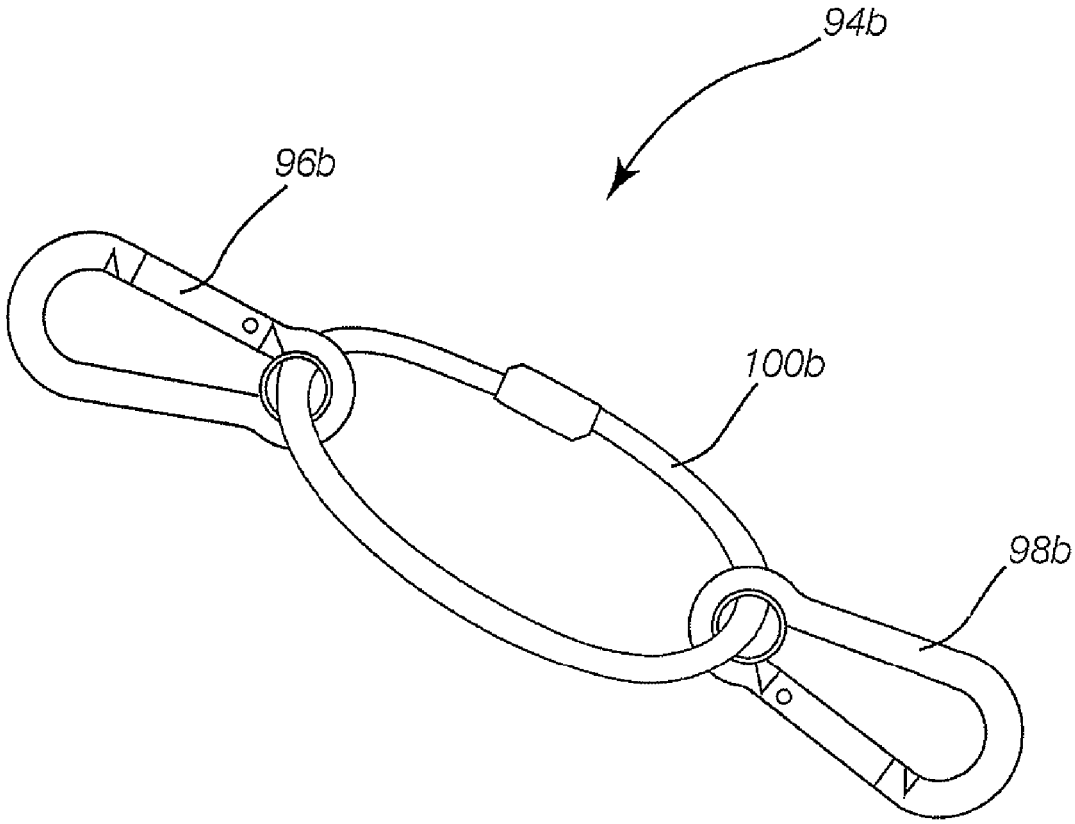
FIG. 3 is front view of an alternative cable member for practicing the invention.

The kit 10*a* can also include sets of eye-bolts 88*a* and nuts 90*a*, such as four sets, one for each corner of the sign. The kit 10*a* can also include a cap 92*a* for the top of the column 16*a*, to enhance the aesthetic appearance of the kit 10*a* when suspending a sign. The kit 10*a* can also include cable members 94*a*, such as four cable members, one for each corner of the sign. The cable member 94*a* can include latches 96*a*, 98*a* at both ends, with a stretchable member 100*a* (such as rubber or elastomeric material) extending between the S-hooks 96*a*, 98*a*. The S-hook 96*a* can engage the eye-bolt 88*a* and the S-hook 98*a* can engage an eyelet 102*a* on the sign 104*a*. The use of the cable members 94*a* in the kit 10*a* can reduce the likelihood and/or severity of creep or plastic deformation of the column 16*a*. FIG. 3 shows an alternative cable member 94*b* having a stretchable member 100*b* formed as an endless bungee cord and two latches 96*b*, 98*b*. Each latch 96*b*, 98*b* can include a locking tab that is biased into a closed position (shown in FIG. 3), but can be urged inward to open the latch 96*b*, 98*b* for receiving the eye-bolt 88*a* or the eyelet 102*a*.

During assembly of one side of the signage support, the conical tip 72*a* of the column anchor 12*a* can be placed on the ground and the driving member 78*a* can be inserted in the column sleeve portion 66*a*. A hammer or other object can be struck against the cap 80*a* as often as necessary to drive the column anchor 12*a* substantially fully into the ground. It is desirable to leave the boss 74*a* exposed above ground level.

The column 16*a* can then be placed in the column sleeve portion 66*a*. The extent that the column 16*a* projects into the column sleeve portion 66*a* can be controlled by rotating the thumbscrew 76*a* inward to press against and hold the column 16*a* when the column 16*a* is in the desired position. This can be desirable when the sign is being suspended on uneven ground and the columns must be positioned differently. The boss 74*a* can be oriented at a non-perpendicular angle relative to the column sleeve portion 66*a* so that the thumbscrew 76*a* can be rotated without interference from the ground.

After the columns are positioned, eye-bolts 88*a* and nuts 90*a* are assembled in the desired apertures 20*a*, 22*a*, 24*a*, 26*a*. Next, latches 96*a* of cable members 94*a* are connected to the eye-bolts 88*a* and latches 98*a* are connected to eyelets 102*a*. Caps 92*a* can inserted in the top ends of the columns.

After the suspension of the sign is no longer desired, the cable members 94*a* can be disconnected from the sign 104*a* and the eye-bolts 88*a* and nuts 92. The eye-bolts 88*a* and nuts 92 can be disconnected from the column 16*a*. The thumbscrew 76*a* can be unscrewed and the column 16*a* can be removed from the column anchor 12*a*. The cap 44*a* can be inserted into the column sleeve portion 66*a* and disassembly can be complete.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A kit for suspending a sign comprising: first and second column anchors operable to be mounted in the ground, each column anchor having a plurality of fins facing in different directions from one another and a conical tip, wherein each of said first and second columns include respective sleeve portions and each fin is further defined as a substantially flat plate fixed to said sleeve portion and each individually extending laterally past opposite sides of said sleeve portion and said plurality of fins are spaced from one another along said sleeve to define first and second surfaces wider than said respective sleeve portion at different elevation along the sleeve and facing different, transverse directions from one another;

first and second columns individually receivable in one of the said first and second column anchors and selectively removable and each having a plurality of through-apertures;

a plurality of sets of eye-bolts and nuts each individually receivable in one of said plurality of through-apertures; and plurality of cable members having one of latches and S-hooks at both ends and also having a stretchable member extending between said one of latches and S-hooks.

2. The kit of claim 1 further comprising:

at least one driving member receivable in both of the respective said first and second column anchors prior to said first and second columns being received in said first and second column anchors to drive said first and second column anchors into the ground.

3. The kit of claim 1 wherein each of said fins extends a height along said sleeve portion and both are mounted flush to said respective sleeve portion along said entire height.

4. The kit of claim 3 wherein each of said fins is shaped substantially as a rectangle with two chamfers at opposite bottom edges, said chamfers easing insertion in the ground and also minimizing the loss of surface area of said first and second surfaces for stabilizing said sleeve portion.

5. A kit for suspending a sign comprising:

first and second column anchors operable to be mounted in the ground, each column anchor having a plurality of fins facing in different directions from one another and a conical tip, wherein each of said first and second column anchors include a boss defining a threaded through-aperture;

first and second columns individually receivable in one of the said first and second column anchors and selectively removable and each having a plurality of through-apertures;

a plurality of sets of eye-bolts and nuts each individually receivable in one of said plurality of through-apertures;

a plurality of cable members having one of latches and S-hooks at both ends and also having a stretchable member extending between said one of latches and S-hooks;

at least one driving member receivable in both of the respective said first and second column anchors prior to said first and second columns being received in said first and second column anchors to drive said first and second column anchors into the ground; and said kit further comprises first and second thumbscrews individually receivable in one of said bosses to capture one of said first and second columns at a desired position.

6. The kit of claim 5 wherein said bosses are oriented at a non- perpendicular angle relative to said respective first and second column anchors such that said thumbscrews can be rotated without interference from the ground.

7. The kit of claim 6 further comprising:

first and second caps individually receivable in one of said first and second column anchors and selectively removable, the first and second column anchors receiving the first and second caps when the first and second columns have been removed.

8. The kit of claim 7 further comprising:

first and second caps individually receivable in a top end of one of said first and second columns and selectively removable.

9. A post stabilizer system operable to be positioned underground and comprising:

a shaft portion being hollow for receiving a post extending above the ground or itself part of the post;

a first plate being substantially flat and fixed to said shaft portion and extending laterally past opposite sides of said shaft portion; and a second plate being substantially flat and fixed to said shaft portion and extending laterally past opposite sides of said shaft portion, wherein said first and second plates are spaced from one another along said shaft portion and are transverse one another to define first and second surfaces wider than said shaft portion at different elevation along the sleeve and facing different, transverse directions from one another.

10. The post stabilizer system of claim 9 wherein each of said first and second plates extends a height along said shaft portion and both are mounted flush to said respective shaft portion along said entire height.

11. The post stabilizer system of claim 10 wherein each of said first and second plates is shaped substantially as a rectangle with two chamfers at opposite bottom edges, said chamfers easing insertion in the ground and also minimizing the loss of surface area of said first and second surfaces for stabilizing said sleeve portion.

* * * * *